US011011015B2

(12) United States Patent
Achmueller et al.

(10) Patent No.: US 11,011,015 B2
(45) Date of Patent: May 18, 2021

(54) GAMING SYSTEM AND METHOD PROVIDING PERSONAL AUDIO PREFERENCE PROFILES

(71) Applicant: IGT, Las Vegas, NV (US)

(72) Inventors: Klaus Achmueller, Kalsdorf bei Graz (AT); David Small, Moncton (CA); David Froy, Lakeville-Westmorland (CA); Stefan Keilwert, St. Josef (AT)

(73) Assignee: IGT, Las Vegas, NV (US)

( * ) Notice: Subject to any disclaimer, the term of this patent is extended or adjusted under 35 U.S.C. 154(b) by 90 days.

(21) Appl. No.: 16/259,235

(22) Filed: Jan. 28, 2019

(65) Prior Publication Data

US 2020/0242887 A1 Jul. 30, 2020

(51) Int. Cl.
*G07F 17/32* (2006.01)

(52) U.S. Cl.
CPC ..... *G07F 17/3227* (2013.01); *G07F 17/3206* (2013.01); *G07F 17/3223* (2013.01)

(58) Field of Classification Search
CPC ..... G07F 17/3227; G07F 17/3206; G07F 17/3223; G07F 17/32; G07F 17/3237
See application file for complete search history.

(56) References Cited

U.S. PATENT DOCUMENTS 3,831,172 A 8/1974 Olliges et al.
4,339,798 A 7/1982 Hedges et al.
4,363,482 A 12/1982 Goldfarb
4,496,149 A 1/1985 Schwartzberg
4,582,324 A 4/1986 Koza et al.
4,618,150 A 10/1986 Kimura
4,624,459 A 11/1986 Kaufman
4,660,107 A 4/1987 Chippendale, Jr.
4,695,053 A 9/1987 Vazquez, Jr. et al.
4,974,857 A 12/1990 Beall et al.
5,096,195 A 3/1992 Gimmon
5,179,517 A 1/1993 Sarbin et al.
5,221,801 A 6/1993 Bruti et al.
5,242,163 A 9/1993 Fulton
5,275,400 A 1/1994 Weingardt et al.
5,342,047 A 8/1994 Heidel et al.
5,371,345 A 12/1994 LeStrange et al.
5,390,938 A 2/1995 Takeya
5,393,061 A 2/1995 Manship et al.
5,429,507 A 7/1995 Kaplan
5,430,835 A 7/1995 Williams et al.
5,449,173 A 9/1995 Thomas et al.
5,472,197 A 12/1995 Gwiasda et al.
5,668,996 A 9/1997 Radinsky
5,695,188 A 12/1997 Ishibashi
5,697,843 A 12/1997 Manship et al.
5,707,286 A 1/1998 Carlson
(Continued)

*Primary Examiner* — William H McCulloch, Jr.
*Assistant Examiner* — Ankit B Doshi
(74) *Attorney, Agent, or Firm* — Neal, Gerber & Eisenberg LLP

(57) ABSTRACT

Various embodiments are provided for personalized acoustical optimization in gaming system. The gaming system facilitates creation of a personal audio preference profile for a player and stores that profile. Responsive to the player initiating game play at an electronic gaming machine, the gaming system communicates the personal audio preference profile to the electronic gaming machine for use during the game play at the electronic gaming machine.

17 Claims, 6 Drawing Sheets

(56) References Cited

U.S. PATENT DOCUMENTS 5,762,552 A 6/1998 Vuong et al.
5,766,074 A 6/1998 Cannon et al.
5,772,509 A 6/1998 Weiss
5,792,972 A 8/1998 Houston
5,807,172 A 9/1998 Piechowiak
5,833,538 A 11/1998 Weiss
5,839,958 A 11/1998 Ozarow
5,848,932 A 12/1998 Adams
5,876,284 A 3/1999 Acres et al.
5,902,184 A 5/1999 Bennett et al.
5,908,354 A 6/1999 Okuniewicz
5,910,048 A 6/1999 Feinberg
5,967,894 A 10/1999 Kinoshita et al.
5,997,401 A 12/1999 Crawford
6,015,346 A 1/2000 Bennett
D421,277 S 2/2000 McGahn et al.
6,056,642 A 5/2000 Bennett
6,062,979 A 5/2000 Inoue
6,071,192 A 6/2000 Weiss
6,084,169 A 7/2000 Hasegawa et al.
6,089,976 A 7/2000 Schneider et al.
6,089,978 A 7/2000 Adams
6,102,400 A 8/2000 Scott et al.
6,106,393 A 8/2000 Sunaga et al.
6,110,041 A 8/2000 Walker et al.
6,110,043 A 8/2000 Olsen
6,113,495 A 9/2000 Walker
6,117,009 A 9/2000 Yoseloff
6,126,165 A 10/2000 Sakamoto
6,142,875 A 11/2000 Kodachi et al.
6,146,273 A 11/2000 Olsen
6,146,276 A 11/2000 Okuniewicz
6,155,925 A 12/2000 Giobbi et al.
6,159,097 A 12/2000 Gura
6,174,233 B1 1/2001 Sunaga et al.
6,174,235 B1 1/2001 Walker
6,175,632 B1 1/2001 Marx
6,217,448 B1 4/2001 Olsen
6,238,288 B1 5/2001 Walker et al.
6,241,612 B1 6/2001 Heredia
6,254,481 B1 7/2001 Jaffe
6,270,411 B1 8/2001 Gura et al.
6,302,790 B1 10/2001 Brossard
6,306,034 B1 10/2001 Sakamoto et al.
6,309,299 B1 10/2001 Weiss
6,309,301 B1 10/2001 Sano
6,328,648 B1 12/2001 Walker et al.
6,390,923 B1 5/2002 Yoshitomi et al.
6,409,596 B1 6/2002 Hayashida et al.
6,416,411 B1 7/2002 Tsukahara
6,537,152 B2 3/2003 Seelig et al.
6,544,122 B2 4/2003 Araki et al.
6,554,703 B1 4/2003 Bussick et al.
6,561,908 B1 5/2003 Hoke
6,599,195 B1 7/2003 Araki et al.
6,638,169 B2 10/2003 Wilder et al.
6,656,046 B1 12/2003 Yoseloff et al.
6,729,618 B1 5/2004 Koenig et al.
6,769,985 B1 8/2004 Laakso et al.
6,848,996 B2 2/2005 Hecht et al.
6,935,955 B1 8/2005 Kaminkow et al.
6,939,226 B1 9/2005 Joshi
7,105,736 B2 9/2006 Laakso
7,258,613 B2 8/2007 Lucchesi et al.
7,355,112 B2 4/2008 Laakso
7,666,098 B2 2/2010 Hecht et al.
7,708,642 B2 5/2010 Hecht et al.
7,867,085 B2 1/2011 Pryzby et al.
7,892,091 B2 2/2011 Laakso et al.
7,901,291 B2 3/2011 Hecht et al.
8,025,562 B2 9/2011 Walker et al.
8,025,566 B2 9/2011 Walker et al.
8,029,353 B2 10/2011 Walker et al.
8,029,362 B2 10/2011 Walker et al.
8,077,195 B2 12/2011 Groβmann
8,113,935 B2 2/2012 Walker et al.
8,184,824 B2 5/2012 Hettinger et al.
8,360,841 B2 1/2013 Walker et al.
8,435,105 B2 5/2013 Paulsen
8,485,881 B2 7/2013 Griswold et al.
8,500,562 B2 8/2013 Walker et al.
8,591,308 B2 11/2013 Hoffman et al.
8,690,662 B2 4/2014 Walker et al.
8,702,517 B2 4/2014 Walker et al.
8,758,131 B2 6/2014 Decker et al.
8,777,744 B2 7/2014 Basallo et al.
8,814,649 B2 8/2014 Walker et al.
8,821,266 B2 9/2014 Nicely
8,992,298 B2 3/2015 Walker et al.
8,992,299 B2 3/2015 Walker et al.
9,033,799 B2 5/2015 Decker et al.
9,039,410 B2 5/2015 Walker et al.
9,582,970 B2 2/2017 Rosenblatt
9,630,106 B2 4/2017 Decker et al.
10,016,673 B1 7/2018 Milligan et al.
10,134,228 B2 11/2018 McIntyre et al.
10,134,230 B2 11/2018 Okada et al.
10,163,295 B2 12/2018 Miura
2002/0077165 A1 6/2002 Bansemer et al.
2003/0073490 A1 4/2003 Hecht et al.
2003/0100359 A1 5/2003 Loose et al.
2004/0023709 A1 2/2004 Beaulieu et al.
2008/0113716 A1 5/2008 Beadell et al.
2012/0115608 A1 5/2012 Pfeifer et al.
2014/0018153 A1* 1/2014 Nelson ..... G07F 17/3223 463/25
2015/0213691 A1 7/2015 Dunn
2015/0243124 A1 8/2015 Decker et al.
2016/0092156 A1 3/2016 Miura
2016/0180644 A1 6/2016 Idris et al.
2017/0287287 A1 10/2017 Froy et al.
2017/0294072 A1 10/2017 Achmuller et al.
2018/0040190 A1 2/2018 Keilwert et al.
2018/0078854 A1 3/2018 Achmueller et al.
2018/0089935 A1 3/2018 Froy, Jr.
2018/0130283 A1 5/2018 Froy et al.

* cited by examiner

GAMING SYSTEM AND METHOD PROVIDING PERSONAL AUDIO PREFERENCE PROFILES

BACKGROUND

The present disclosure relates to gaming systems, and more particularly gaming systems that enable play of wagering games. Such gaming machines typically require the player to place a wager to activate a play of the primary game. Many of these gaming machines may determine and provide the awards based on the player obtaining a winning symbol or symbol combination and on the amount of the wager. Many of these gaming machines may also provide one or more secondary games that provide one or more additional awards to the player. These gaming machines may output various audio (including music and/or spoken words) associated with the plays of the primary and secondary games. These gaming machines may also output various audio before and after the plays of the primary and secondary games. These gaming machines may include an input device that enables a player to manually adjust the volume of the audio outputted by the gaming machine.

BRIEF SUMMARY

Various embodiments of the present disclosure provide gaming systems and methods that provide player personal audio preference profiles to optimize and enhance player interaction.

Various embodiments of the present disclosure provide a method for operating a gaming system including detecting a player at an electronic gaming machine, receiving, via the electronic gaming machine, a personal audio preference profile for the player from a remote personal audio preference profile storage device, and using, via the electronic gaming machine, the received personal audio preference profile to output audio based on the personal audio preference profile. The method further includes subsequently outputting adjusted audio, and responsive to receiving an approval of the outputted adjusted audio from the player via an input device, automatically modifying the personal audio preference profile based on the outputted adjusted audio and communicating the modified personal audio preference profile to the remote personal audio preference profile storage device.

Various embodiments of the present disclosure provide a method for operating a gaming system including detecting a player at an electronic gaming machine, causing the electronic gaming machine to provide game play for the player, and causing the electronic gaming machine to create a personal audio preference profile for the player during the game play provided by the electronic gaming machine. Creating the personal audio preference profile includes obtaining an input from the player regarding the player's personal audio preferences and obtaining data from a database not associated with the gaming system and that stores a player personal audio preference. The method further includes communicating the created personal audio preference profile to a remote personal audio preference profile storage device.

Various embodiments of the present disclosure provide an electronic gaming machine including a display device, a sound producing device, an input device, a processor, and a memory device that stores a plurality of instructions, which when executed by the processor, causes the processor to: detect, via the input device, that a player has initiated game play, display, via the display device, the game play, and use a personal audio preference profile for the player to output audio via the sound producing device and based on the personal audio preference profile. The plurality of instructions, when executed by the processor, further causes the processor to receive data associated with ambient noise and output via the sound producing device audio offsetting to the ambient noise.

Additional features are described in, and will be apparent from, the following Detailed Description and the figures.

DETAILED DESCRIPTION

Figure 1:
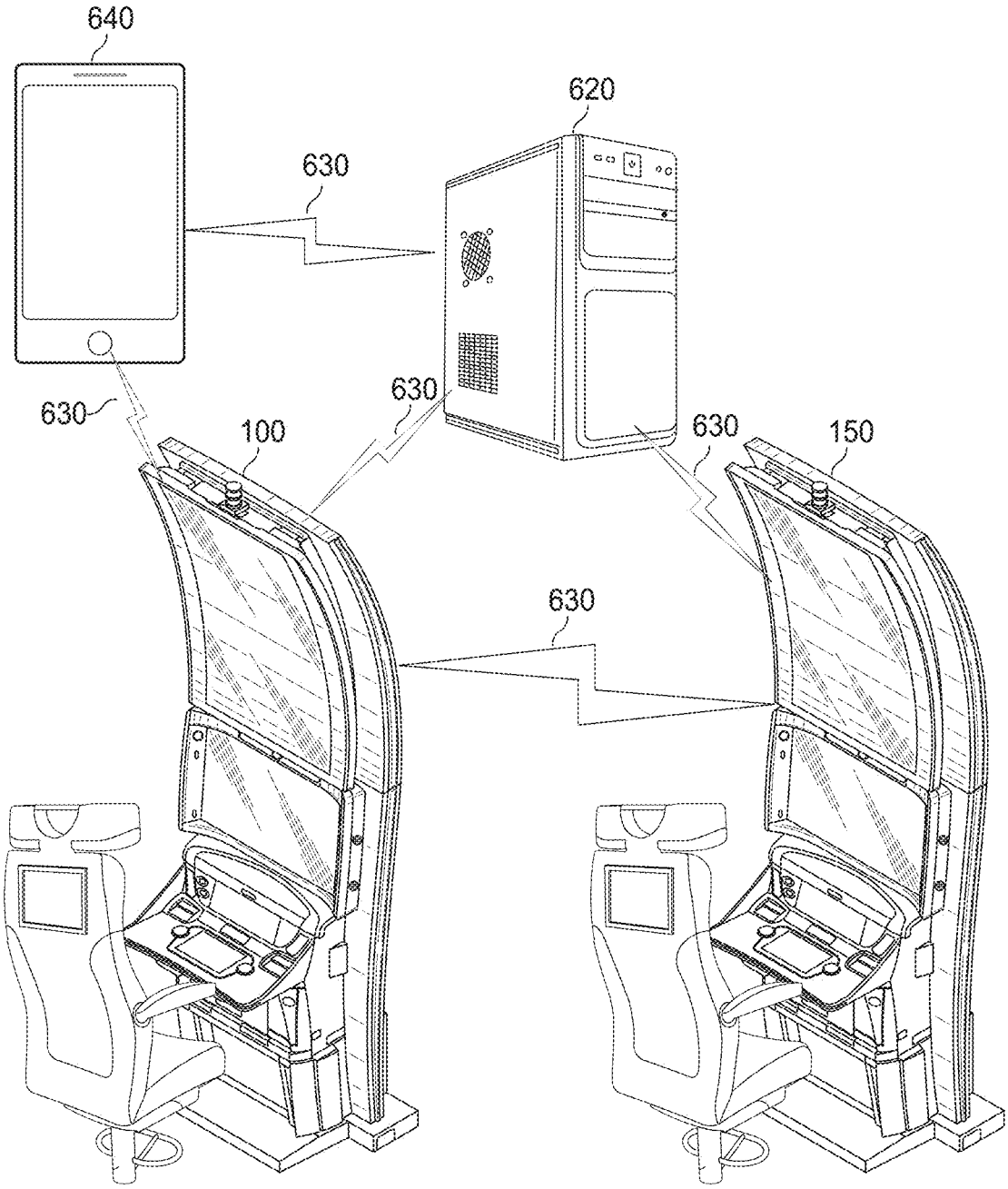
FIG. 1 is a front perspective view of one example embodiment of a gaming system of the present disclosure, and illustrating a plurality of example electronic gaming machines of the gaming system, a plurality of player chairs of the gaming system, a player personal audio preference profile storage and access device of the gaming system, and a player mobile device that can be part or used in conjunction with the gaming system.

In various embodiments, the present disclosure provides gaming systems and methods of operating gaming systems that provide and use player personalized audio preferences stored in personal player audio preference profiles to enhance player interaction in a plurality of different situations and in a plurality of different manners. For brevity and clarity, and unless specifically stated otherwise, such personal player audio preference profiles may sometimes be referred to as: personal audio preference profiles, player audio preference profiles, audio preference profiles, preference profiles, or profiles.

In various embodiments, the gaming system includes one or more electronic gaming machines ("EGM(s)"). In various other embodiments, the present disclosure includes one or more EGMs and one or more remote personal player audio preference profile storage devices. In various other embodiments, the present disclosure also includes one or more player chairs associated with one or more of the EGMs. In various other embodiments, the present disclosure also includes one or more player personal devices such as player mobile devices that are part of the gaming system or configured to operate with the gaming system. For brevity and clarity, and unless specifically stated otherwise, the term "EGM" is used herein to refer to an electronic gaming machine (such as but not limited to a slot machine, a video poker machine, a video card machine, a video lottery terminal (VLT), a video keno machine, a video bingo machine, and a sports bettering terminal).

The present disclosure provides technological advancements to gaming systems and EGMs within gaming environments, and more particularly, audio (such as acoustical) enhancements to gaming systems and EGMs operating within these gaming environments. In view of the ever-increasing popularity of gaming environments (e.g., casinos) by various players (i.e., patrons such as players), a "one size fits all" approach to adapting characteristics of EGMs operating therein to the needs or desires of the various players may fail to provide an optimal experience, as the players are typically of a wide variety of age, personal characteristics, personal tastes, hearing characteristics (e.g., one player may find a higher or lower frequency range more desirable than another), and the like. In the context of the functionality detailed herein, the sound characteristics of audio generated by a particular EGM which is engaging and pleasing to one player may not be ideal or well-suited to another player. Moreover, as a player may shift or otherwise physically move during game play at an EGM, the sound characteristics heard by the player as generated by the EGM may vary according to the position (such as the orientation) of the player's head/ears. This may provide an unpleasant gaming experience, especially taking into consideration the active surroundings (of many other players and many other EGMs generating additional audio in close proximity to the player) of the gaming environment.

Accordingly, various aspects of the present disclosure provide audio processing and computing enhancements of EGMs, and methods of operating such enhanced EGMs. Particularly disclosed is apparatus that enables and facilitates the creation of a personalized or personal player audio preference profile by each player, where the personal audio preference profile contains sound characteristics settings established per the desires and tastes of the player. Once created, this personal audio preference profile may then be stored in a central storage location (such as in a player personal audio preference profile storage and access device) and be communicated to any particular EGM of the gaming system upon determining that the player has initiated a game play session at the EGM (or upon another suitable triggering event). That is, upon identifying that a particular player has approached, "carded-in", or otherwise initiated a game play session at an EGM within the gaming environment, the personal audio preference profile associated with the particular player is communicated from the central storage location to the EGM of which the player has initiated game play and is thereby activated or employed (e.g., the sound characteristic settings of the EGM are adjusted according to one or more or all of the sound characteristic settings stored within the personal audio preference profile) for a duration of the game play at the EGM. Subsequently, when the player initiates game play at a another EGM within the gaming environment, the personal audio preference profile is again communicated to this alternative EGM from the central storage location. Hence, notwithstanding which game, type of game, type of EGM, etc., the player is currently engaged with, the sound characteristics of audio generated thereof are automatically adjusted according to the stored preferences of the instant player.

In certain embodiments, the central storage location may include a centralized gaming server within the gaming environment which is in communication with or configured to communicate with the EGM (and other EGMs within the gaming environment). Thus, when the player initiates a game play session at one of the EGMs, the personal audio preference profile is therefore communicated from this central gaming server to that EGM.

In other embodiments, the central storage location may comprise a mobile device (e.g., smartphone, tablet, laptop, etc.) associated with the player. In this embodiment, when the player approaches, logs into, or otherwise initiates a game play session at an EGM using the player's associated mobile device, the personal audio preference profile is communicated from the mobile device to that EGM.

In various other embodiments, a multitude of other devices and methods may store and communicate the personal audio preference profile to the EGM (and vice versa so as to communicate the personal audio preference profile from the EGM to the storages device), such as smart headphones, player identification cards, tracking devices, etc. as further described herein.

In certain embodiments, the personal audio preference profile may be developed using apparatus of the EGM. For example, in one embodiment, the EGM may monitor and/or track portions of a player's head (and/or ears) using one or more EGM sensors as the player moves during game play, and adjust sound characteristics of audio produced by the EGM according to the movement of the player in real time.

One disclosed method of implementation of this includes scanning, tracking, or otherwise locating the player's ear structure to determine a focal point for which the sound of the audio outputted by the EGM is or should be directed. Once the player ear structure is identified using the EGM sensor(s), sound characteristics of the audio outputted by the EGM may be adjusted according to various criterion (and stored within the personal audio preference profile) to provide an optimal and enjoyable gaming experience for the player.

Referring now to FIGS. 1, 2, 3, and 4, an example of a gaming system including a plurality of EGMs, a plurality of player chairs, a player personal audio preference profile storage and access device, and a player mobile device (that can be part or used in conjunction with the gaming system) of the present disclosure is generally illustrated. It should be appreciated that, although EGM 100 and EGM 150 are depicted, the gaming system may include additional EGMs (not shown). Further, it should be noted, for simplicity of understanding the present disclosure, that EGM 100 and EGM 150 are depicted to be substantially similar and as having identical components comprised thereof. However, in an actual implementation, many variations exist between EGMs of differing types and EGM 100 and EGM 150 may each be unique with regard to the type of game(s) executed thereon, the type of hardware used therein, the configuration of the EGMs, etc. EGM 100 and EGM 150 as used herein are intended to refer to any electronic gaming machine known in the art notwithstanding whether or not the EGM 100 and EGM 150 are identical in composition.

Figure 2:
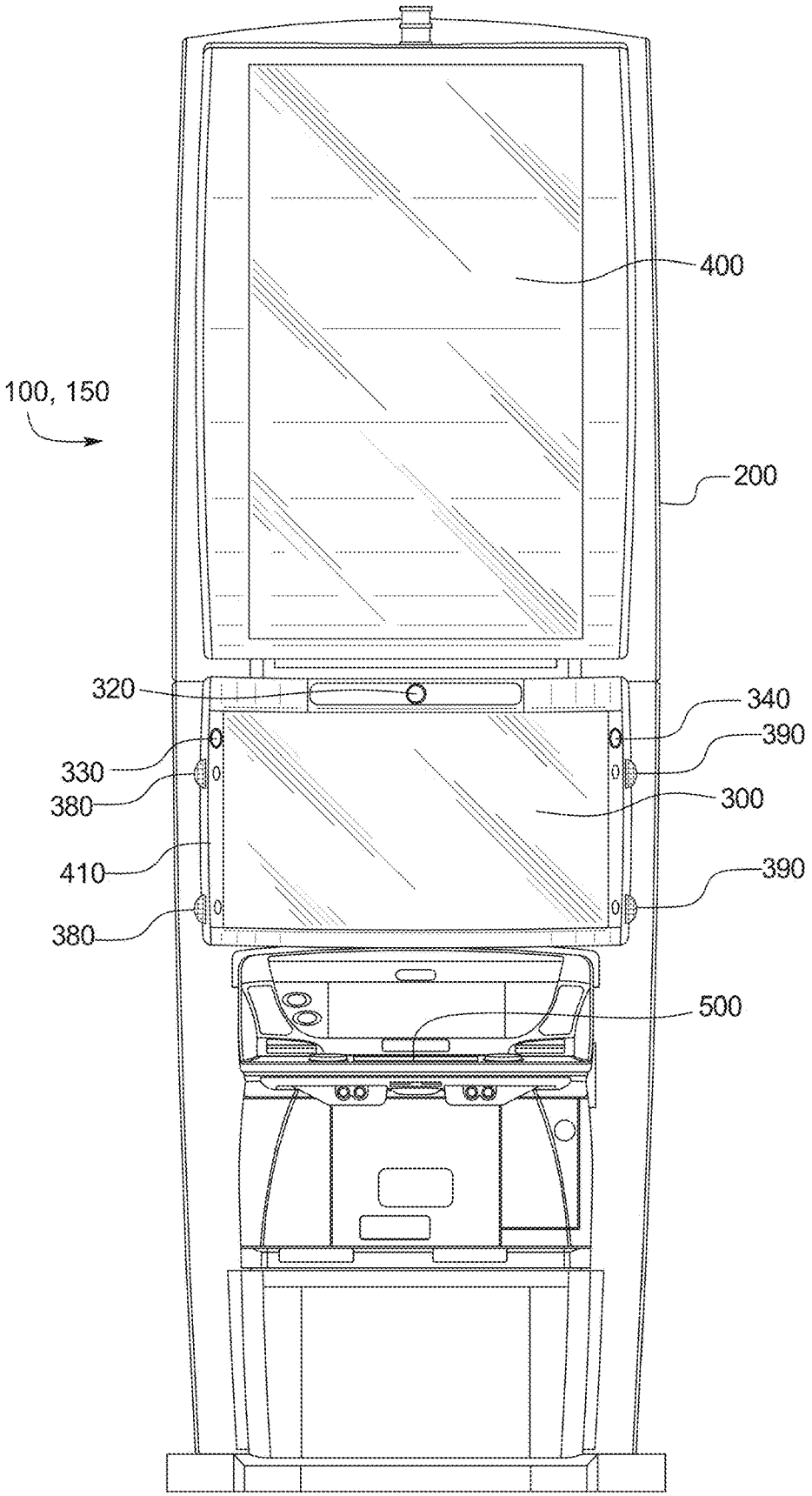
FIG. 2 is a front view of one of the electronic gaming machines of the gaming system of FIG. 1.
Figure 3:
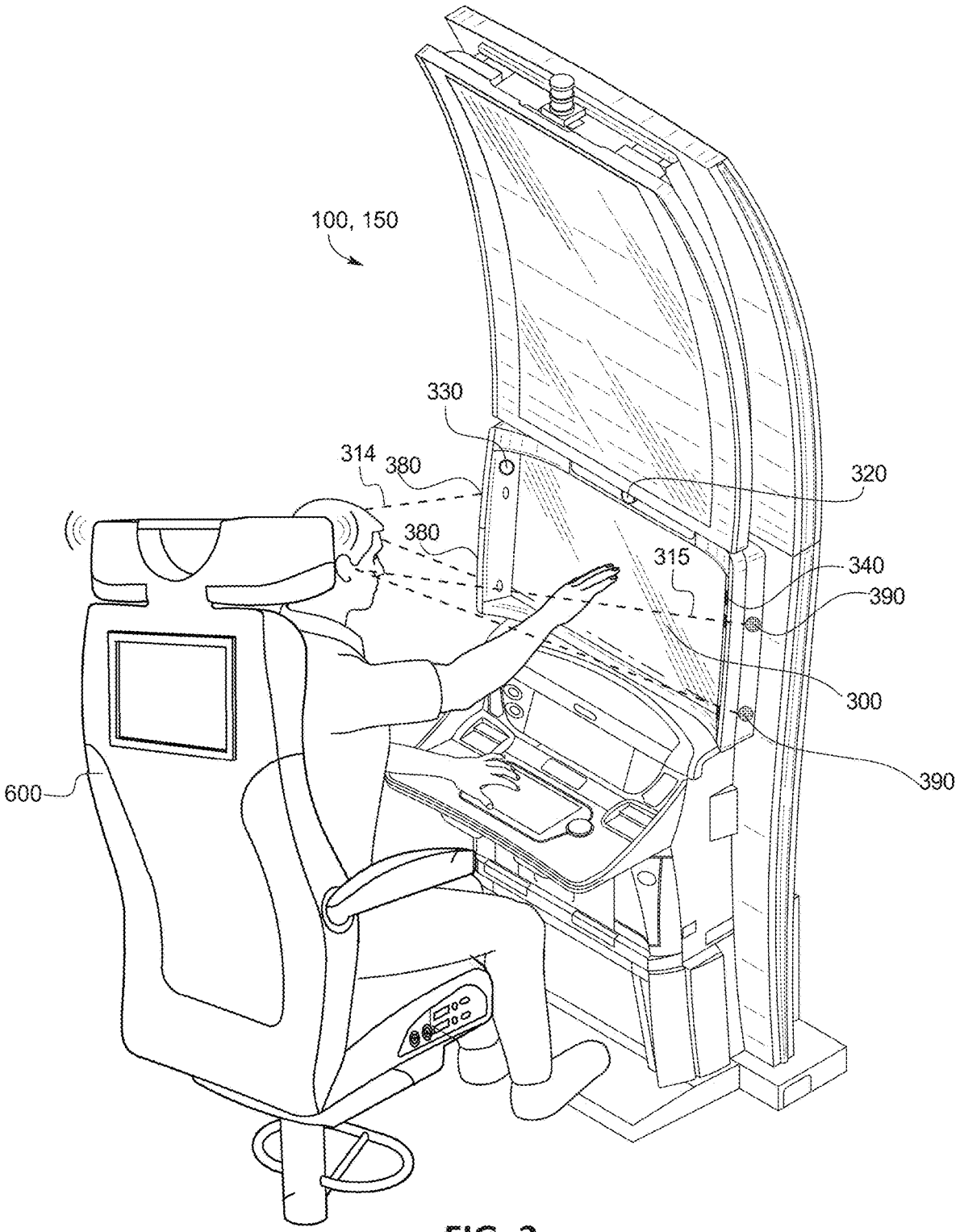
FIG. 3 is a front perspective view of one of the electronic gaming machines and an associated player chair of the gaming system of FIG. 1, showing in phantom head/ear tracking zones provided by the electronic gaming machine.
Figure 4:
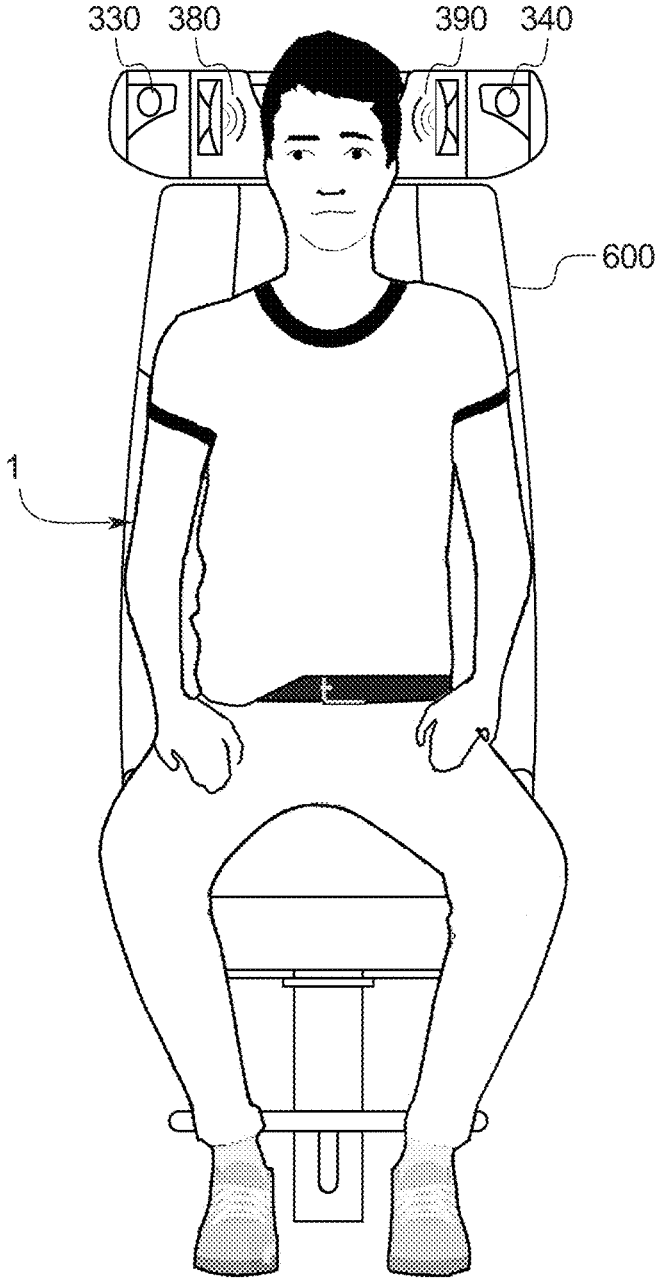
FIG. 4 is a front view of a player seated at a player chair associated with one of the electronic gaming machines of the game system of FIG. 1.

The example EGMs 100 and 150 illustrated in FIGS. 1, 2, 3, and 4 generally each include a support structure such as a cabinet 200 that support a plurality of output devices and a plurality of input devices of the EGMs 100 and 150 among other components. In this illustrated example embodiment, the plurality of output devices include: a first (intermediate) display device 300; a second (upper) display device 400 positioned above the first display device 300; and a third (lower) display device 500 positioned below the first display device 300. The plurality of output devices further include a plurality of sound producing devices such as a plurality of speakers 380 and 390 located at various portions within or substantially near to the EGMs 100 and 150. At least some of the speakers 380 and 390, for example, may be integrated within the cabinet 200, and others of the speakers 380 and 390 may be integrated into player chairs such as player chair 600 associated with the EGM 100 or 150. The player chairs may or may not be physically attached to the respective EGMs 100 and 150 and may include sound producing devices such as speakers within the headrest of the seat 600, as shown in FIG. 4. These output devices are configured to display and generate sounds associated with games (such as implemented using gaming programs executed by the processor of the EGMs), game outcomes, awards (such as primary and secondary games awards or other game outcome awards), and other functionality and/or information associated with the EGMs to players such as player 1 (shown in FIG. 4).

The EGMs 100 and 150 depicted in FIGS. 1, 2, 3, and 4 may also respectively include a plurality of player input devices. In this illustrated example embodiment, the respective plurality of player input devices enable the player to play one or more wagering games provided by the EGMs 100 and 150. Such player input devices can also include one or more of the input devices described below in the second section of this detailed description. These player input devices are physically activatable by a player to enable the player to make inputs into the EGMs 100 or 150. These output devices and input devices are configured such that a player may operate the EGM 100 or 150 while standing or sitting, but preferably operates the EGM while the player is sitting (e.g., on a player chair such as player chair 600) in front of the EGM 100 or 150 such that the player's head is approximately at the same height as the first display device 300 (as generally shown in FIG. 3).

In various embodiments of the present disclosure, the EGMs 100 and 150 of the present disclosure each may include one or more of the following: the first display device 300 configured to display game play functionality, which in some embodiments may include three-dimensional ("3D") images displayable to the player; a player head locator 320 (e.g., a camera) configured to track the movement of the head (eyes, and/or ears) of the player; and one or more processors and memory devices that co-act or work together with the above mentioned components to provide the enhanced physical player interaction with the EGM. It should be appreciated that the first display device 300 and the player head locator 320, may each be individually configured or may alternatively be configured to operate with the one or more processors and memory devices to provide each of their designated functions described herein. In other words, the first display device 300 may be individually configured to display gaming images, or may be configured to operate with the one or more processors and memory devices to display the images; and the player head locator 320 may be individually configured to track the movement of the head (eyes and/or ears) of the player, or may be configured to operate with the one or more processors and memory devices to track the movement of the head (eyes, and/or ears) of the player. Thus, for purposes of this disclosure and for brevity, each of these devices are sometimes discussed as performing such tasks individually or operating with the one or more processors and memory devices to perform such task, and such descriptions are not intended to limit the present disclosure to either configuration.

In this illustrated example embodiment, each head locator 320 of the respective EGM 100 or 150 is configured to track or determine the position(s) of at least one of the player's head in front of the first display device 300 further includes a plurality of cameras 330 and 340 supported by the cabinet 200 and positioned adjacent to the first display device 300. In this illustrated embodiment, one camera 330 is positioned directly to the right of the display device 300 (looking forward toward the player) and one camera 340 is positioned directly to the left of the display device 300 (looking forward toward player). In this illustrated embodiment, the plurality of cameras 330 and 340 are positioned adjacent to the upper right hand corner of the display device 300 and the other of the plurality of cameras is positioned adjacent to the upper left hand corner of the display device 300. It should be appreciated that in an alternative embodiment, the cameras are to be positioned adjacent to the lower right hand corner of the first display device 300 and positioned adjacent to the lower left hand corner of the first display device 300. It should be appreciated that in other alternative embodiments, the cameras 330 and 340 can be otherwise alternatively positioned in accordance with the present disclosure, such as in upper left and right portions of the seat 600, respectively. It should also be appreciated that in other alternative embodiments, the EGMs can include only one such camera or more than two such cameras in accordance with the present disclosure.

In various embodiments, the cameras 330 and 340 are or include three-dimensional cameras having depth map creation capabilities, such as time of flight (TOF) depth camera sensors, positioned at the two opposite sides of the first display device 300 and focused inwardly somewhat towards each other. This configuration enables the cameras 330 and 340 to track objects such as one or more of the player's ears in the relatively narrow right and left player ear tracking zones 314 and 315 (such as shown in FIG. 3), respectively. In various embodiments, the TOF depth camera sensors make the EGMs less prone to occlusions. In various embodiments, the TOF depth cameras also deliver point clouds that can be quickly analyzed and used by the processor(s) to make the necessary determinations. It should be appreciated that other suitable depth sensors (other than TOF sensors) may be employed in accordance with the present disclosure.

In various embodiments, the EGMs 100 and 150 each use the image data provided by the respective player head locator 320 and/or cameras 330 and 340 to determine the position(s) of the player's ears in the right and left player ear tracking zones 314 and 315 in real time as the player at that EGM moves their head during game play. In certain embodiments, the EGM creates the object depth images using point clouds provided by three dimensional cameras (e.g., the TOF depth cameras) and merges these point clouds to create one optimized point cloud that represents the object(s) such as the player's ear(s) in right and left player ear tracking zones 314 and 315. This provides a high degree of accuracy and a relatively large coverage area (than would a one camera system, such as when using the head locator 320 alone). The EGMs 100 and 150 may use the image data provided by the cameras 330 and 340 to determine (and/or store) a size and shape of the ear structure of the player's ears within the ear tracking zones 314 and 315 within the field of view of the first display device 300.

In certain embodiments, the cameras 330 and 340 may comprise a stereo pair of cameras that are generally pointed at each of the player's ears to determine the real time location thereof as the player moves about during game play.

In certain embodiments, facial recognition technology, Infrared depth map algorithms, and/or interference patterns may be used to determine this head movement and positioning in real time. In other words, the EGMs 100 and 150 may determine the size, shape, and real time positioning of the player's ears in three-dimensional space (i.e., the xyz coordinate relative to the first display device 300). The EGMs 100 and 150 may then use the image data provided by the cameras 330 and 340 to determine movements or gestures by the player's head, again, in real time.

In certain embodiments, the EGMs 100 and 150 may include one or more camera sync cables (not shown) that sync the cameras 330 and 340 to enhance the accuracy of the determination of the position(s) of the player's head and/or ear(s) in the right and left player ear tracking zones 314 and 315. It should be appreciated that the image data from the multiple cameras can be synced in other suitable manners in accordance with the present disclosure. For example, in other embodiments, the cameras 330 and 340 may feed image data to the processor(s) of the respective EGMs 100 or 150 which receive the image data and assemble the synchronization thereof based on receipt time of data delivery and/or image data in real time. Notwithstanding, the head locator 320 and the cameras 330 and 340 (whether the cameras are integrated into the cabinet 200, the player chair 600, or both) may work individually or collectively to determine the movements or gestures of the player's head and/or ears during game play while seated at the respective EGM 100 or 150.

In the illustrated example embodiment of the EGMs 100 of 150 of the present disclosure shown in FIGS. 1, 2, 3, and 4, the cameras 330 and 340 are positioned directly to the right and left of first display device 300 (and additionally and/or alternatively within the player chairs associated with the respective EGMs 100 and 150). It should be appreciated that in an alternative embodiment of the present disclosure, the cameras 330 and 340 may be placed in any other suitable location.

The EGMs 100 and 150 may each be in communication or configured to communicate with one or more centralized servers (e.g., a gaming server, a player tracking server, an accounting server, etc.). For simplicity, central gaming server 620 is shown in FIG. 1, however it should be appreciated that central gaming server 620 may perform the following disclosed functionality alone, or these functions may be provided through multiple different servers (not shown) in communication with the EGMs 100 and 150. The central gaming server 620 may comprise a computing device having at least one processor and memory device, and communicate with various components (e.g., the EGMs 100 and 150) through a suitable networks such as network 630.

The central gaming server 620 can be part of the network 630 that includes a communication link between the central gaming server 620 and EGMs 100 and 150 and/or other component(s) with which communication is desired. A communication interface may be associated with the central gaming server 620 and each device or component for facilitating the communication. The communication interfaces may have a variety of architectures and utilize a variety of protocols such as IEEE-1394 (FireWire™) or Ethernet in the case where the communication link is a wired link, or a wireless link utilizing a wireless protocol such as WIFI, Bluetooth™, Radio Frequency (RF), Infrared, third generation partnership project (3GPP) long term evolution (LTE), Worldwide interoperability for Microwave Access (WiMAX), High Speed Packet Access (HSPA), etc. The communication links may transmit electrical, electromagnetic or optical signals, which carry digital data streams, or analog signals representing various types of information.

In certain embodiments, the central gaming server 620 may be configured to perform player-tracking functions. For example, the central gaming server 620 may store information regarding the identities of players and information regarding the game play of those players. This information may include, for example, time of play, coin in/coin out or other monetary transaction data, and in an arrangement where players are awarded points based on play, a players point total. In certain embodiments, the central gaming server 620 may also be configured to perform financial related functions, such as track financial transactions such as bets and payouts, and perform reconciliations with monies collected from the EGMs 100 and 150.

In certain embodiments, the EGMs 100 and 150 and the central gaming server 630 (and/or other servers, not shown) may communicate through the network 630 with a mobile device 640. In other embodiments, the mobile device 640 may connect to the EGMs 100 and 150 using a different network other than network 630, such that the network 630 providing communication between the EGMs 100 and 150 and the central gaming server 620 is a separate network (not shown) than network 630. The mobile device 640 may comprise a computing device having a processor and memory device to perform various functionality executed thereon. The mobile device 640 is generally associated with a particular player (such as player 1) and may comprise a smartphone, tablet, laptop computer, or other suitable mobile electronic device. For the purposes of simplicity, mobile device 640 is generally illustrated in FIG. 1 to be a smartphone or tablet device, however it should be appreciated that the mobile device 640 may also comprise a variety of other types of mobile electronics, such as smart headphones, two-way communication tracking cards, etc.

Personal Audio Preference Profiles

In this section, EGM 100 is used as the primary example. As mentioned above, when listening to audio (e.g., sounds associated with a particular game, game event sounds, advertisements, music, etc.) produced through the speakers 380 and 390 of the EGM 100, varying different players of may have vastly different listening experiences, especially when the audio is generally not "customized" to the specific player (e.g., with regard to equalization (EQ) settings, volume, and the like) and physical positioning of the speakers 380 and 390 is generally static (not movable) within the EGM 100 and/or the associated player chair such as player 600 associated with the EGM 100. Moreover, as the player moves about the player chair 600 while engaged in game play at the EGM 100, the player may inadvertently move away from an optimal listening location (such as a specific physical position) which may hinder their ability to directly hear the audio being generated by the speakers 380 and 390 of the EGM 100.

Accordingly, the present disclosure provides apparatus and methods for identifying, creating, and storing personal audio preference profiles (in a central location, such as central gaming server 620 and/or on a mobile device associated with the player, such as mobile device 640), and retrieving and activating the personal audio preference profile for a duration of game play responsive to the player associated with the personal audio preference profile having approached, logged-in, and/or otherwise initiated a game play session at a particular one of the EGMs 100 and 150 to enhance the experience of the player according to their personal preferences during the game play session.

In various embodiments, the personal audio preference profile may include sound characteristic settings, as set or determined by the player and/or EGM 100, which include frequency adaptation settings, volume settings, personalized equalization settings, fading settings (e.g., between the left speakers 380 and right speakers 390 and/or between the front speakers 380 and 390 of the EGM 100 and the player chair 600), audio compression settings, etc. as described herein.

In one embodiment, the personal audio preference profile may be created a player on the EGM 100 by engaging with and providing inputs to the EGM 100. The EGM 100 may prompt the player, at some point during an initiated game play session, whether the player would like to create and/or modify the personal audio preference profile. The player may then input or adjust various sound characteristic settings (e.g., using touch-based inputs on the first display device 300 or third display device 500) as the EGM 100 plays various gaming audio through the speakers 380 and 390 so as to enable the player to hear adjustments to the sound characteristics of the audio in real time. Once the player is satisfied with the adjustments to the sound characteristics, the EGM 100 may then provide an option (e.g., including activation of a physical and/or virtual input device such as a button) to automatically save these adjustments to their personal audio preference profile. The updated personal audio preference profile may then be communicated from the EGM 100 to be stored via the network 630 on the central gaming server 620.

The personal audio preference profile for player may then be retrieved from another EGM such as EGM 150 upon the player initiating game play, and the personal audio preference profile is then activated (i.e., the sound characteristics of the audio reproduced by the speakers 380 and 390 of the alternative EGM 150 is adjusted commensurate with the settings contained within the personal audio preference profile) thereon.

The following example illustrates this process. The EGM enables the player 1 to initiate a game play session on the EGM 100, wherein upon initiating the game play session, the EGM 100 prompts the player 1 as to whether the player 1 desires to create a personal audio preference profile. Responsive to an affirmative input from the player, the EGM 100 enables the player 1 to proceed to select and adjust each of a plurality of different settings corresponding to an "audio profile" sub-application executing on the EGM 100 while beginning (or continuing) to play games such as primary wagering games (or other activity) on the EGM 100 and with the EGM producing audio from the speakers 380 and 390 of the EGM 100. While the player 1 listens to the audio output of the EGM 100, the EGM 100 enables the player to use one or more of the input devices to select various on-screen (e.g., displayed through one of the display devices 300, 400, or 500) displayed option menus regarding sound characteristic settings such as associated with frequency adaptation settings, volume settings, personalized equalization settings, fading settings, etc. to adjust the properties of the audio output of the speakers 380 and 390 of the EGM 100. The EGM 100 enables this to be done by the player while the player continues game play on the EGM 100 if the player desires. Once the player 1 is satisfied with the sound characteristic adjustment settings, the EGM 100 enables the player 1 to select a "save" option (again generated within the context of the audio tuning sub-application) to update the player's personal audio preference profile with the newly adjusted settings.

In certain embodiments, in lieu of providing the audio tuning sub-application, the EGM 100 may dynamically update the personal audio preference profile any time a certain change is detected in lieu of prompting the player 1 to save the given settings. That is, in an example where the player 1 merely changes the volume on the EGM 100 (i.e., during game play and without entering any sub-applications), the EGM 100 automatically saves this setting to the player's personal audio preference profile for potential future use. Upon saving (or dynamically updating) the personal audio preference profile settings, the EGM 100 then communicates the personal audio preference profile of the player through the network 630 to the central gaming server 620.

The player 1 then may decide to switch to another EGM such as EGM 150, which may be executing a different game or type of game (or the player 1 may leave after concluding their game play session on the EGM 100 and return to the gaming environment at a later time/date to initiate game play on another EGM such as EGM 150). The EGM 150, responsive to receiving identifying information of the player 1, transmits this identifying information through the network 630 to the central gaming server 620. Upon identifying that player 1 has initiated game play at the EGM 150, the central gaming server 620 may then communicate the personal audio preference profile of the player 1 to the EGM 150 via the network 630. The sound characteristics of audio outputted by EGM 150 may be adjusted by EGM 150 commensurate with the settings contained within the received personal audio preference profile.

In certain embodiments, the personal audio preference profile may be automatically activated at the EGM 150 for a duration of the player's game play session.

In other embodiments, the EGM 150 may prompt the player as to whether the player would like to activate their personal audio preference profile, and implement the settings contained therein upon receiving an affirmative response from the player. If the player does not wish to activate the personal audio preference profile pursuant to the prompt, the EGM 150 may use default audio settings contained therein.

In various embodiments, the EGM 100 may identify the player as having approached, logged-in, and/or otherwise initiated the game play session using various different manners. In one example, the EGM 100 may recognize and identify the player upon determining that the player has inserted a card (e.g., a gaming establishment tracking card, a credit card, etc.) into the EGM 100. In another example, the EGM 100 may recognize and identify the player using a barcode, Quick Response (QR) code, player identification number, or other identifying manner printed and/or embedded onto a ticket inserted into the EGM 100 by the player. In another example, the player may be biometrically identified using one or more biometric input devices associated with the EGM 100 (e.g., fingerprint readers, facial recognition technology, etc.). In another example, the player 1 may be recognized and identified upon determining that a mobile device 640 associated with player has approached (i.e., come within a predetermined distance), connected, or established a game play session at EGM 100.

It should be appreciated that certain gaming establishments (or suppliers thereof) have developed (or currently are developing) card-less and cashless systems that enable patrons to fund games and pay for goods and services using various gaming establishment application(s) on their mobile device 640. These applications may be linked to a cashless or virtual account managed by the gaming establishment that may in turn be linked to one or more financial institution accounts (e.g., bank, credit union, or other external funding accounts). Using these systems, a player may "card-in" (i.e., login, or more specifically, establish a gaming session) to the EGM 100 (or a gaming kiosk) using their mobile device 640 by establishing a connection from their respective mobile device 640 to the EGM 100 over a Bluetooth®, Near Field Communication (NFC), or Wi-Fi protocol, or by other mechanism such as interacting with a QR code associated with the EGM. Once a gaming session is established between the mobile device 640 and the EGM 100, players are, again, able to fund wagers and receive potential winnings associated with the game they are playing using the virtual account managed by the gaming establishment, where the virtual account may be ultimately funded by an external account at a bank or other financial institution outside the gaming establishment. This gaming establishment application may additionally transfer the identifying information of the player to retrieve their associated personal audio preference profile from the central gaming server 620 upon establishing the connection between the mobile device 640 and the EGM 100.

In certain embodiments, in addition and/or alternatively to storing the personal audio preference profile within the central gaming server 620, the personal audio preference profile may be stored by the mobile device 640. Accordingly, the personal audio preference profile may be transferred from the mobile device 640 to the EGM 100 through the network 630 upon the player initiating the game play session (e.g., using the gaming establishment application executing on the mobile device 640). In one example, the gaming establishment application (or an alternative application) executing on the mobile device 640 may provide the functionality referred to within the context of the audio tuning sub-application discussed previously. That is, within the gaming establishment application, a tool-set of options may be provided for the player to modify or adjust the sound characteristic settings associated with the personal audio preference profile. Similar to the EGM 100, the mobile device 640 may generate certain gaming or other audio as the player adjusts the sound characteristics so as to enable the player to hear the adjustments the player is inputting (or requesting) in real time. Certain of these options may include, for example, the frequency adaptation settings, sound pressure level (SPL) settings, volume settings, personalized equalization settings, fading settings (e.g., between the left speakers 380 and right speakers 390 and/or between the front speakers 380 and 390 of the respective EGM and the player chair), audio compression settings, etc. Upon the player interacting with this portion of the gaming establishment (or other) application executing on the mobile device 640, these settings may be saved within the gaming establishment application and communicated to the EGM 100 after the EGM sends the identifying information associated with player to initiate the game play session.

In certain embodiments, the audio tuning sub-application or sub-portion of the gaming establishment application executing on the mobile device 640 may integrate with one or more other applications executing on the mobile device 640 that are capable of determining and/or storing audio preference profile data. In other words, the personal audio preference profile may be in part or in whole created by the player's audio preference setting in another database or application—and thus automatically obtained for the player.

In one such example, the player may have a music streaming application (e.g., Google Play®, Apple Music®, Spotify®, etc.) executing on their mobile device 640 within which they have already adjusted various audio settings therein. The personal audio preference profile is automatically created or modified in part or in whole based on such audio setting.

In another such example, the mobile device 640 may itself contain previously stored sound characteristic settings in a music application for audio stored thereon (i.e., non-streamed music stored within the mobile device 640). The personal audio preference profile is created or modified in part or in whole based on such audio setting.

In another such example, the mobile device 640 may retrieve preferred audio characteristic settings stored within a third-party or cloud-based service, which may or may not include a music streaming service. The personal audio preference profile is created or modified in part or in whole based on such audio setting.

In various cases, these preferred audio settings may be communicated to the gaming establishment application and/or the EGM themselves through an integration with the respective application, file, or profile (subsequent to an integration approval from the player) of the mobile device 640.

In certain embodiments, the mobile device 640 may communicate only the parameters (e.g., only the defined settings) of the personal audio preference profile, whether developed from the gaming establishment application or another integrated application, to the EGM 100 and/or the central gaming server 620 such that no personal identifying information is transmitted from the mobile device 640.

In certain embodiments, the mobile device 640 may additionally and/or alternatively be used in conjunction with the EGM 100 to adjust the sound characteristics in real time as the player engages in the game play session thereon. In one example, an input device (e.g., a microphone) of the mobile device 640 may be used to record or monitor ambient sound substantially near the player as the player engages in game play at EGM 100. In one example, an input device (e.g., a microphone) of the EGM 100 may be used to record or monitor ambient sound substantially near the player as the player engages in game play at EGM 100. This ambient sound may then be transformed into data (and if obtained by the mobile device communicated to the respective EGM 100) enable the EGM 100 to actively equalize the audio output and/or provide noise cancellation functionality (through one or more suitable noise cancelation devices). In various embodiments, the sounds outputted by the noise cancellation devices will be configured to not contradict or interfere with the sounds outputted by the EGM based on game play and based on the player's personal preferences stored in the personal audio preference profile.

In certain embodiments, the personal audio preference profile, in addition to containing personalized sound characteristic settings for gaming sounds/music, may aid the EGM 100 and/or the mobile device 640 in determining responsive actions to facilitate other game play functionality. That is, the personal audio preference profile of the player may contain additional information relating to the type of game and type of audio information the player appreciates to hear. For example, the EGM 100, the mobile device 640, and/or the central gaming server 620 may analyze the player's personal audio preference profile (such as using one or more artificial intelligence (AI) algorithms) to determine other audio content or information the player is predicted to desire, such as specific news, weather, or sports feeds (and at what specific times the player may desire to hear this other audio information). This other audio content may then be generated by the EGM 100, mobile device 640, and/or served from the central gaming server 620 at the specific times determined as part of the analyzation. It should thus be appreciated that the audio data processing can thus be performed partially or wholly by the EGM internally, or can be performed partially or wholly external to the EGM (such as by one or more mobile devices or servers). In one example, certain of the processing of audio data can be done by the EGM and certain can be done by a server remote from the EGM. In another example, the analysis of the streaming of audio parameters can be analyzed and/or calculated by one device and processed by a second device. In another example, the preprocessing of audio data can be done by one device and sent to another device for real-time processing. In various embodiments, various back and forth communications are employed to between such devices to establish and share audio connections, audio parameters, and communications settings.

Similarly, in certain embodiments, the AI functionality provided by analyzing the player's personal audio preference profile may be used to modify the personal audio preference profile of the player depending on one or more factors such as but not limited to: the time of day the player is engaged in game play, the type of game the player is engaged with (e.g., with association to a particular volatility, community or single player, game theme, etc.), the game event, the gaming environment occupancy (e.g., the SPL/volume of the game may be adjusted higher in a crowded environment), etc. Additionally, the AI functionality may adjust the player's personal audio preference profile according to a determined "way" the player is engaged with playing a particular game. In other words, if the player is determined to be playing the particular game aggressively, the personal audio preference profile may be adjusted corresponding to the nature of the engagement of the player (e.g., the volume may be adjusted higher commensurate with a determined higher engagement level of the player with the game). In another example, the sound characteristics of the personal audio preference profile may be adjusted if the AI functionality suggests the player is unsuccessful at the particular game or predicted to shortly discontinue game play.

To facilitate developing the personal audio preference profile, in various embodiments, a scanning technique for identifying and tracking in real time the head, eyes, and/or ears of the player using the cameras 330 and 340 and/or the player head locator 320 to accurately capture the ear tracking zones 314 and 315 in front of the first display device 300 is further provided. It should be noted that the player head locator 320 and the cameras 330 and 340 may additionally be referred to herein as simply "object sensors". These components, again, may act individually, co-act or work in conjunction with one another to identify characteristics of the head, eyes, and/or ears of player to perform the various functionality disclosed herein.

In certain embodiments, and referring to the ear tracking zones 314 and 315 of FIG. 3, cameras 330 (which may comprise one or more cameras integrated into a left side of the first display device 300 and/or one or more cameras integrated into a left side of the player chair 600) may be substantially pointed to capture imaging information from a left portion of the player's head. This imaging information may be used by a processor of the EGM 100 to direct a focal point of audio/sound outputted by speakers 380 (which may comprise one or more speakers integrated within a left side of the cabinet 200 and/or one or more speakers integrated within a left side of the seat 600) substantially toward the player's left ear. Similarly, cameras 340 (which may comprise one or more cameras integrated into a right side of the first display device 300 and/or one or more cameras integrated into a right side of the player chair 600) may be substantially pointed to capture imaging information from a right portion of the player's head. This additional imaging information may be used by the processor of the EGM 100 to direct a focal point of audio/sound generated or reproduced by speakers 390 (which may comprise one or more speakers integrated within a right side of the cabinet 200 and/or one or more speakers integrated within a right side of the seat 600) substantially toward the player's right ear. In this way, one or more of the player's ears (or at least some portion of the player's ears and/or head) is scanned and tracked (as the player moves their head) by the cameras 330 and 340 respectively, and the imaging information obtained therefrom may be used to adjust the focal point of the sound outputted by the respective speakers 380 and 390 using various software-based (e.g., EQ settings, fading, etc.) and/or mechanical-based (e.g., repositioning of the speakers themselves using electronic motors and/or adjusting a cone or diaphragm of the speakers 380 and 390 using various manners). This information may be saved as at least a part of the personal audio preference profile and stored within the EGM 100, mobile device 640, and/or the central gaming server 620.

It should be noted that, beyond the focal point (i.e., the direction) of the sound waves produced by the speakers 380 and 390, other sound characteristics or properties may be adjusted according to various criterion. These sound characteristics may include, for example, a volume/SPL, a frequency range, a loudness, a pitch, a sonic texture, a duration, an amplitude, or any other defined properties of sounds. In various embodiments, the sound characteristics may additionally be adjusted by a channel separation of various sounds output through the respective speakers 380 and 390 and/or synchronize the sound output of ones of the respective speakers 380 and 390 to one another. For example, the audio output of speakers 380 and 390 of the player chair 600 may in some cases be synchronized to the speakers 380 and 390 of the cabinet 200. In other cases, the audio output of speakers 380 and 390 of the player chair 600 may be delayed relative to the audio output of the speakers 380 and 390 of the cabinet 200 to create a "concert hall" type effect or to project sound into a perceived front and/or in back position ahead or behind the player. In certain embodiments, the sound of the audio output may be synchronized (or delayed) corresponding to game events, 3D game effects, or other various game play functionality associated with game play of the EGM 100.

In certain embodiments, this sound characteristic adjustment may be performed according to what is referred to herein as a "player type". For example, a player type may comprise a relative height of the player (e.g., a shorter versus a taller player). Thus, when player is a shorter player (relative to the size/height of the player chair 600), the ear tracking zones 314 and 315 may be adjusted accordingly to direct the focal point of the sound produced by the speakers 380 and 390 "down" toward the player's ears such that the sound waves produced by speakers 380 and 390 are deflected downward toward the player's ears. Conversely, when player is a taller player (relative to the size/height of the player chair 600), the ear tracking zones 314 and 315 may be adjusted accordingly to direct the focal point of the sound produced by the speakers 380 and 390 "up" toward the player's ears such that the sound waves produced by speakers 380 and 390 are deflected upward toward the player's ears.

In another example, the player type may include an age (or age range) of the player. In one embodiment, the EGM 100 may prompt the player at some portion during commencement of game play, to input their age (or age range) using the first display device 300 or some other input device associated with the EGM 100. The EGM 100 may then use this information to adjust the sound characteristics of audio reproduced by the speakers 380 and 390 according to a predefined profile (i.e., a profile stored within the EGM 100 or on a central gaming server in communication with the EGM 100 (not shown)) so as to change the properties of the sound commensurate with those properties known to generally be desirous to a particular age group (e.g., an older player may find the sound characteristics more pleasing if higher frequencies of the audio are amplified/accentuated and lower frequencies are attenuated).

In certain embodiments, when scanning the head, eyes, and/or ears of player, the cameras 330 and 340 may work in conjunction with the processor of the EGM 100 to identify that the player is wearing one or more hearing aid devices. In other embodiments, the player may input this information manually or may be prompted to confirm the detection of the one or more hearing aid devices via input of the first display device 300 or other input device of the EGM 100. That is, in conjunction with the scanning, the EGM 100 may initially identify that the player is wearing one or more hearing aid devices in one or more of the player's ears. The EGM 100 may then, to confirm this finding, display a prompt on the first display device 300 (or display device 500, for example) requesting the player to validate that the one or more hearing aid devices are indeed being worn by the player and in which ear(s). The EGM 100 may then use this information to adjust the sound characteristics of audio reproduced by the speakers 380 and 390, respectively, according to the personal audio preference profile stored within the EGM 100, mobile device 640, and/or on the central gaming server 620 in communication with the EGM 100 so as to change the properties of the sound commensurate with those properties known to generally be optimal to the properties associated with hearing aids. The sound characteristics may be adjusted for which ear (i.e., left ear, right ear, or both ears) of the player which is determined to include the hearing aid device. In various embodiments, a hearing aid frequency profile may be developed and stored as at least part of the personal audio preference profile for player on the EGM 100, mobile device 640, and/or on the central gaming server 620 in communication with the EGM 100. The hearing aid frequency profile may be part of the audio tuning application discussed infra. In one example, the hearing aid frequency profile may be developed by player using the audio tuning application executing on the mobile device 640 (either within the gaming environment or outside the gaming environment) associated with the player.

It should be noted that, while these examples refer to the "hearing aid frequency profile", that other embodiments exist where the player does not use any hearing aids and generally wishes to tune the sound characteristics of the audio produced during game play to their liking. For example, in some embodiments, an ear profile may be developed and stored as part of the personal audio preference profile. The ear profile may comprise an identified pattern of the player's (or an aggregate sample of many players) ears. Upon initiating a subsequent game play session at the EGM 100 (or an alternative EGM within the gaming environment), the ear structure profile may be identified in conjunction with the scanning by the cameras 330 and 340 (and/or the player head locator 320) and the appropriate sound settings may again be adjusted pursuant to initiating game play on the EGM 100.

Figure 5:
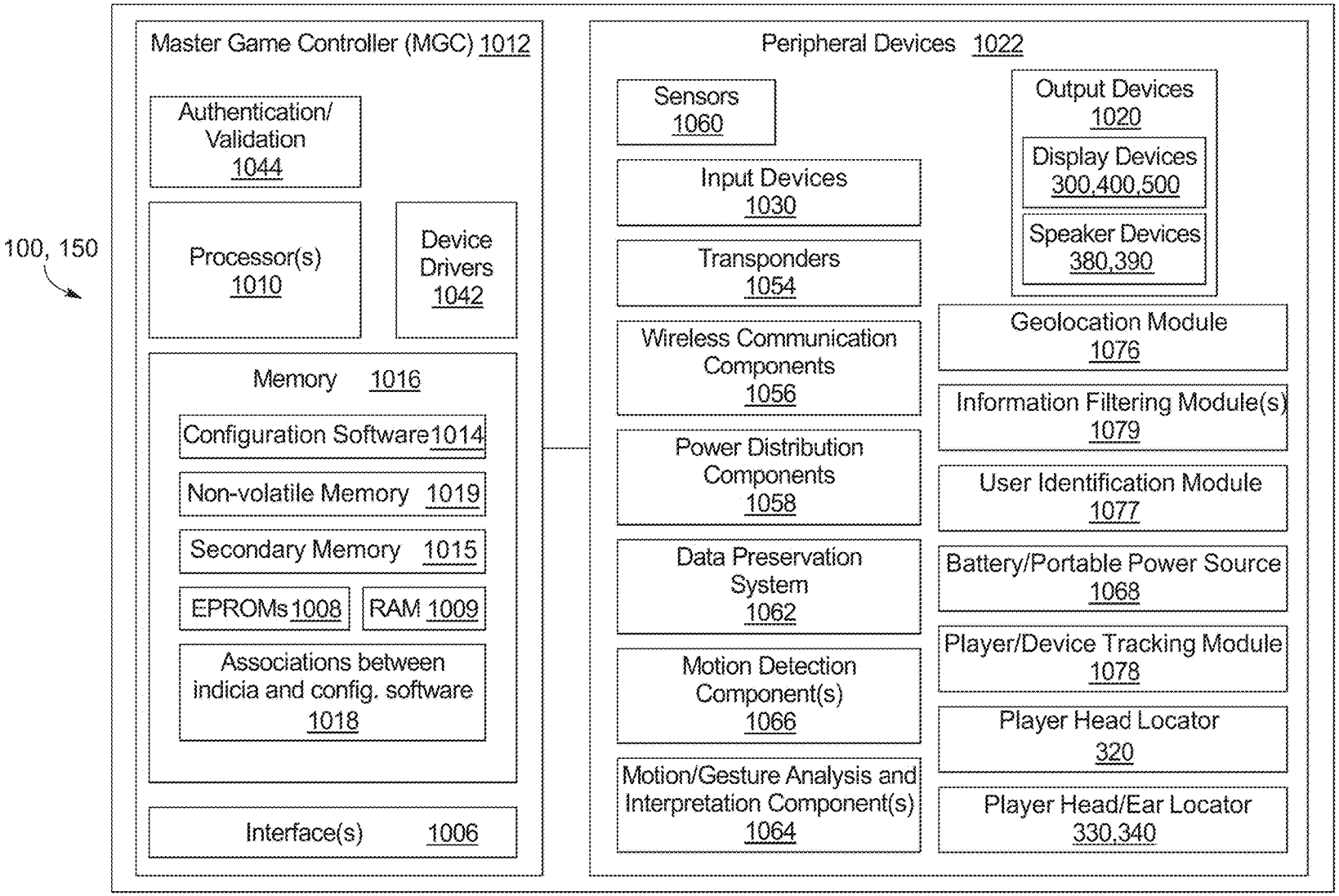
FIG. 5 is a schematic block diagram of one exemplary embodiment of the electronic configuration of one of the electronic gaming machines of the gaming system of FIG. 1.

Referring now to FIG. 5, in various embodiments, the EGMs 100, 150 each include a master game controller 1012 configured to communicate with and to operate with a plurality of peripheral devices 1022 in addition to display devices 300, 400, 500, player head locator 320, and player head/ear locators (cameras) 330 and 340.

The master game controller 1012 (e.g., a master gaming controller) includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: communicating with a remote source (such as a server that stores authentication information or game information) via a communication interface 1006 of the master gaming controller 1012; converting signals read by an interface to a format corresponding to that used by software or memory of the EGMs; accessing memory to configure or reconfigure game parameters in the memory according to indicia read from the EGMs 100, 150; communicating with interfaces and the peripheral devices 1022 (such as input/output devices); and/or controlling the peripheral devices 1022. In certain embodiments, one or more components of the master game controller 1012 (such as the at least one processor 1010) reside within a housing of the EGMs 100, 150, while in other embodiments at least one component of the master game controller 1012 resides outside of the housing of the EGMs 100, 150.

The master game controller 1012 also includes at least one memory device 1016, which includes: volatile memory (e.g., RAM 1009, which may include non-volatile RAM, magnetic RAM, ferroelectric RAM, and any other suitable forms); non-volatile memory 1019 (e.g., disk memory, FLASH memory, EPROMs, EEPROMs, memristor-based non-volatile solid-state memory, etc.); unalterable memory (e.g., EPROMs 1008); read-only memory; and/or a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGMs 100, 150 disclosed herein. In certain embodiments, the at least one memory device 1016 resides within the housing of the EGMs 100, 150 (described below), while in other embodiments at least one component of the at least one memory device 1016 resides outside of the housing of the EGMs 100, 150.

The at least one memory device 1016 is configured to store, for example: configuration software 1014, such as all the parameters and settings for a game playable on the EGMs 100, 150; associations 1018 between configuration indicia read from an EGMs 100, 150 with one or more parameters and settings; communication protocols configured to enable the at least one processor 1010 to communicate with the peripheral devices 1022; and/or communication transport protocols (such as TCP/IP, USB, Firewire, IEEE1394, Bluetooth, IEEE 802.11x (IEEE 802.11 standards), hiperlan/2, HomeRF, etc.) configured to enable the EGMs 100, 150 to communicate with local and non-local devices using such protocols. In one implementation, the master game controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGMs 100, 150 to control the EGMs 100, 150. The at least one memory device 1016 of the EGMs 100, 150 also stores other operating data, such as image data, audio data, event data, input data, random number generators (RNGs) or pseudo-RNGs, paytable data or information, and/or applicable game rules that relate to the play of one or more games on the EGMs. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGMs to implement at least part of the present disclosure. In other embodiments, part or all of the program code and/or the operating data is downloaded to the at least one memory device of the EGMs 100, 150 through any suitable data network described above (such as an Internet or intranet).

The at least one memory device 1016 also stores a plurality of device drivers 1042. Examples of different types of device drivers include device drivers for EGMs components and device drivers for the peripheral devices 1022. Typically, the device drivers 1042 utilize various communication protocols that enable communication with a particular physical device. The device driver abstracts the hardware implementation of that device. For example, a device driver may be written for each type of card reader that could potentially be connected to the EGMs 100, 150. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (Wi-Fi), etc. In one embodiment, when one type of a particular device is exchanged for another type of the particular device, the at least one processor of the EGMs 100, 150 loads the new device driver from the at least one memory device to enable communication with the new device. For instance, one type of card reader in the EGMs 100, 150 may be replaced with a second different type of card reader when device drivers for both card readers are stored in the at least one memory device.

In certain embodiments, the software units stored in the at least one memory device 1016 may be upgraded as needed. For instance, when the at least one memory device 1016 is a hard drive, new games, new game options, new parameters, new settings for existing parameters, new settings for new parameters, new device drivers, and new communication protocols may be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 may be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units may be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGMs components and/or information, such as hardware components, software components, firmware components, peripheral device components, player input device components, information received from one or more player input devices, information stored in the at least one memory device 1016, etc.

In certain embodiments, in addition to the input, output and other components described in the first section above, the peripheral devices 1022 include several device interfaces, such as: at least one output device 1020 including at least one display device (e.g., see display devices 300, 400, 500 of FIGS. 1-3; at least one input device 1030 (which may include contact and/or non-contact interfaces); at least one transponder 1054; at least one wireless communication component 1056; at least one wired/wireless power distribution component 1058; at least one sensor 1060; at least one data preservation component(s) 1062; at least one motion/gesture analysis and interpretation component 1064; at least one motion detection component 1066; at least one portable power source 1068; at least one geolocation module 1076; at least one user identification module 1077; at least one player/device tracking module 1078; and at least one information filtering module 1079.

The at least one output device 1020 includes at least one display device 300, 400, 500 configured to display any game(s) displayed by the EGMs 100, 150 and any suitable information associated with such game(s). Additionally, the at least one output device 1020 includes at least one of the speakers 380, 390 configured to reproduce audio associated with any game(s) executed by the EGMs 100, 150 and any suitable information associated with such game(s). In certain embodiments, the display devices and speakers are connected to or mounted on a housing of the EGMs 100, 150. In various embodiments, the display devices serve as digital glass configured to advertise certain games or other aspects of the gaming establishment in which the EGMs is located. In various embodiments, the EGMs 100, 150 includes one or more of the following display devices: a central display device; (b) a player tracking display configured to display various information regarding a player's player tracking status (as described below); a secondary or upper display device in addition to the central display device and the player tracking display; a credit display configured to display a current quantity of credits, amount of cash, account balance, or the equivalent; and a bet display configured to display an amount wagered for one or more plays of one or more games. For example, the exemplary EGMs 100, 150 illustrated in FIG. 1 includes a first display device 300, a credit display, and a bet display.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGMs 100, 150 are configured to display one or more game and/or non-game images, symbols, and indicia. In certain embodiments, the display devices of the EGMs 100, 150 are configured to display any suitable visual representation or exhibition of the movement of objects; dynamic lighting; video images; images of people, characters, places, things, and faces of cards; and the like. In certain embodiments, the display devices of the EGMs 100, 150 are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGMs 100, 150 receives an actuation of a cashout device (described below), the EGMs 100, 150 causes the payout device to provide a payment to the player. In one embodiment, the payout device is one or more of: a ticket printer and dispenser configured to print and dispense a ticket or credit slip associated with a monetary value, wherein the ticket or credit slip may be redeemed for its monetary value via a cashier, a kiosk, or other suitable redemption system; a bill dispenser configured to dispense paper currency; a coin dispenser configured to dispense coins or tokens (such as into a coin payout tray); and any suitable combination thereof. For example, the exemplary EGMs 100, 150 as illustrated in FIG. 1 may include a ticket printer and dispenser.

In certain embodiments, the at least one output device 1020 includes one or more sound generating devices controlled by one or more sound cards. In one such embodiment, the sound generating device includes one or more speakers or other sound generating hardware and/or software configured to generate sounds, such as by playing music for any games or by playing music for other modes of the EGMs 100, 150, such as an attract mode. For example, the exemplary EGMs 100, 150 illustrated in FIG. 1 includes a plurality of speakers 380 and 390. In another such embodiment, the EGMs 100, 150 provides dynamic sounds coupled with attractive multimedia images displayed on one or more of the display devices to provide an audio-visual representation or to otherwise display full-motion video with sound to attract players to the EGMs 100, 150. In certain embodiments, the EGMs 100, 150 displays a sequence of audio and/or visual attraction messages during idle periods to attract potential players to the EGMs 100, 150. The videos may be customized to provide any appropriate information.

The at least one input device 1030 may include any suitable device that enables an input signal to be produced and received by the at least one processor 1010 of the EGMs 100, 150.

In one embodiment, the at least one input device 1030 includes a payment device configured to communicate with the at least one processor of the EGM to fund the EGM. In certain embodiments, the payment device includes one or more of: a bill acceptor into which paper money is inserted to fund the EGM; a ticket acceptor into which a ticket or a voucher is inserted to fund the EGM; a coin slot into which coins or tokens are inserted to fund the EGM; a reader or a validator for credit cards, debit cards, or credit slips into which a credit card, debit card, or credit slip is inserted to fund the EGM; a player identification card reader into which a player identification card is inserted to fund the EGM; or any suitable combination thereof. The example EGMs 100, 150 illustrated in FIG. 1 may include a combined bill and ticket acceptor and a coin slot.

In certain embodiments, the at least one input device 1030 includes at least one wagering or betting device. In various embodiments, the one or more wagering or betting devices are each: a mechanical button supported by the housing of the EGMs 100, 150 (such as a hard key or a programmable soft key), or an icon displayed on a display device of the EGM (described below) that is actuatable via a touch screen of the EGM (described below) or via use of a suitable input device of the EGMs 100, 150 (such as a mouse or a joystick). One such wagering or betting device is a maximum wager or bet device that, when actuated, causes the EGMs 100, 150 to place a maximum wager on a play of a game. Another such wagering or betting device is a repeat bet device that, when actuated, causes the EGMs 100, 150 to place a wager that is equal to the previously-placed wager on a play of a game. A further such wagering or betting device is a bet one device that, when actuated, causes the EGMs 100, 150 to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: a mechanical button supported by the housing of the EGMs 100, 150 (such as a hard key or a programmable soft key), or an icon displayed on a display device of the EGM (described below) that is actuatable via a touch screen of the EGM (described below) or via use of a suitable input device of the EGMs 100, 150 (such as a mouse or a joystick). After a player appropriately funds the EGMs 100, 150 and places a wager, the EGMs 100, 150 activates the game play activation device to enable the player to actuate the game play activation device to initiate a play of a game on the EGMs 100, 150 (or another suitable sequence of events associated with the EGMs 100, 150). After the EGMs 100, 150 receives an actuation of the game play activation device, the EGMs 100, 150 initiates the play of the game. The exemplary EGMs 100, 150 illustrated in FIG. 1 may include a game play activation device in the form of a game play initiation button. In other embodiments, the EGMs 100, 150 begins game play automatically upon appropriate funding rather than upon utilization of the game play activation device.

In other embodiments, the at least one input device 1030 includes a cashout device. In various embodiments, the cashout device is: a mechanical button supported by the housing of the EGMs 100, 150 (such as a hard key or a programmable soft key), or an icon displayed on a display device of the EGMs 100, 150 that is actuatable via a touch screen of the EGMs 100, 150 or via use of a suitable input device of the EGMs 100, 150 (such as a mouse or a joystick). When the EGMs 100, 150 receive an actuation of the cashout device from a player and the player has a positive (i.e., greater-than-zero) credit balance, the EGM 200 initiates a payout associated with the player's credit balance. The exemplary EGMs 100, 150 illustrated in FIG. 1 may include a cashout device in the form of a cashout button.

In various embodiments, the at least one input device 1030 includes a plurality of buttons that are programmable by the EGMs 100, 150 operable to, when actuated, cause the EGMs 100, 150 to perform particular functions. For instance, such buttons may be hard keys, programmable soft keys, or icons displayed on a display device of the EGMs 100, 150 that are actuatable via a touch screen of the EGMs 100, 150 or via use of a suitable input device of the EGMs 100, 150 (such as a mouse or a joystick). The exemplary EGMs 100, 150 illustrated in FIG. 1 may include a plurality of such buttons.

In certain embodiments, the at least one input device 1030 includes a touch-screen coupled to a touch-screen controller or other touch-sensitive display overlay to enable interaction with any images displayed on a display device. One such input device is a conventional touch-screen button panel. The touch-screen and the touch-screen controller are connected to a video controller. In these embodiments, signals are input to the EGMs 100, 150 by touching the touch screen at the appropriate locations.

In embodiments including a player tracking system, the at least one input device 1030 includes a card reader in communication with the at least one processor of the EGMs 100, 150. The exemplary EGMs 100, 150 illustrated in FIG. 1 may include a card reader. The card reader is configured to read a player identification card inserted into the card reader.

The at least one wireless communication component 1056 includes one or more communication interfaces having different architectures and utilizing a variety of protocols, such as (but not limited to) 802.11 (Wi-Fi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more player input devices near the EGMs 100, 150. In one embodiment, a player input device docking region is provided, and includes a power distribution component that is configured to recharge a player input device without requiring metal-to-metal contact. In one embodiment, the at least one power distribution component 1058 is configured to distribute power to one or more internal components of the EGMs 100, 150, such as one or more rechargeable power sources (e.g., rechargeable batteries) located at the EGMs 100, 150.

In certain embodiments, in addition to the components described in the first section above, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGMs 100, 150 (in addition to the detections described above); detecting the presence and/or identity of various persons (e.g., players, casino employees, etc.), devices (e.g., player input devices), and/or systems within a predetermined proximity to the EGMs 100, 150.

The at least one data preservation system 1062 is configured to detect or sense one or more events and/or conditions that, for example, may result in damage to the EGMs 100, 150 and/or that may result in loss of information associated with the EGMs 100, 150. Additionally, the data preservation system 1062 may be operable to initiate one or more appropriate action(s) in response to the detection of such events/conditions.

In addition to the player eye or head tracker 320, the EGMs 100, 150 of the present disclosure may also include at least one motion/gesture analysis and interpretation component 1064 configured to analyze and/or interpret information relating to detected player movements and/or gestures to determine appropriate player input information relating to the detected player movements and/or gestures with regard to both images and sound generated by the EGMs 100, 150. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGMs 100, 150 to operate in a mobile environment. For example, in one embodiment, the EGMs 100, 150 of FIG. 1 includes one or more rechargeable batteries.

The at least one geolocation module 1076 is configured to acquire geolocation information from one or more remote sources and use the acquired geolocation information to determine information relating to a relative and/or absolute position of the EGMs 100, 150. For example, in one implementation, the at least one geolocation module 1076 is configured to receive GPS signal information for use in determining the position or location of the EGMs 100, 150. In another implementation, the at least one geolocation module 1076 is configured to receive multiple wireless signals from multiple remote devices (e.g., EGMs, servers, wireless access points, etc.) and use the signal information to compute position/location information relating to the position or location of the EGMs 100, 150.

The at least one user identification module 1077 is configured to determine the identity of the current player or current owner of the EGMs 100, 150. For example, in one embodiment, the current player is required to perform a login process at the EGMs 100, 150 in order to access one or more features. Alternatively, the EGMs 100, 150 is configured to automatically determine the identity of the current player based on one or more external signals, such as an RFID tag or badge worn by the current player and that provides a wireless signal to the EGMs 100, 150 that is used to determine the identity of the current player. In at least one embodiment, various security features are incorporated into the EGMs 100, 150 to prevent unauthorized users from accessing confidential or sensitive information.

The at least one information filtering module 1079 is configured to perform filtering (e.g., based on specified criteria) of selected information to be displayed at one or more displays 300, 400, 500 of the EGMs 100, 150.

In various embodiments, the EGMs 100, 150 includes a plurality of communication ports configured to enable the at least one processor of the EGMs 100, 150 to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices.

In certain embodiments, the EGMs 100, 150 is a device that has obtained approval from a regulatory gaming commission, and in other embodiments, the EGMs 100, 150 is a device that has not obtained approval from a regulatory gaming commission.

The EGMs described above are merely examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (sometimes referred to herein as "primary games") and/or any secondary or bonus games or other functions (sometimes referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a remote processor, central server, central controller, or remote host and a changeable EGM, the at least one memory device of the remote processor, central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the remote processor, central server, central controller, or remote host is configured to communicate one or more of the stored executable game programs to the at least one processor of the changeable EGM. In different embodiments, a stored executable game program is communicated or delivered to the at least one processor of the changeable EGM by: embedding the executable game program in a device or a component (such as a microchip to be inserted into the changeable EGM); writing the executable game program onto a disc or other media; or uploading or streaming the executable game program over a data network (such as a dedicated data network). After the executable game program is communicated from the central server, central controller, remote processors, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the EGMs 100, 150 randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the EGMs 100, 150 generates the game outcome(s) and/or the award(s) to be provided based on the associated probabilities. In these embodiments, since the EGMs 100, 150 generates game outcomes and/or awards randomly or based on one or more probability calculations, there is no certainty that the EGMs 100, 150 will ever provide any specific game outcome and/or award.

As noted above, in various embodiments, the EGMs 100, 150 includes one or more executable game programs executable by at least one processor of the EGMs 100, 150 to provide one or more primary games and one or more secondary games. The primary game(s) and the secondary game(s) may comprise any suitable games and/or wagering games, such as, but not limited to: electromechanical, video slot or spinning reel type games; video card games such as video draw poker, multi-hand video draw poker, other video poker games, video blackjack games, and video baccarat games; video keno games; video bingo games; and video selection games.

Figure 6:
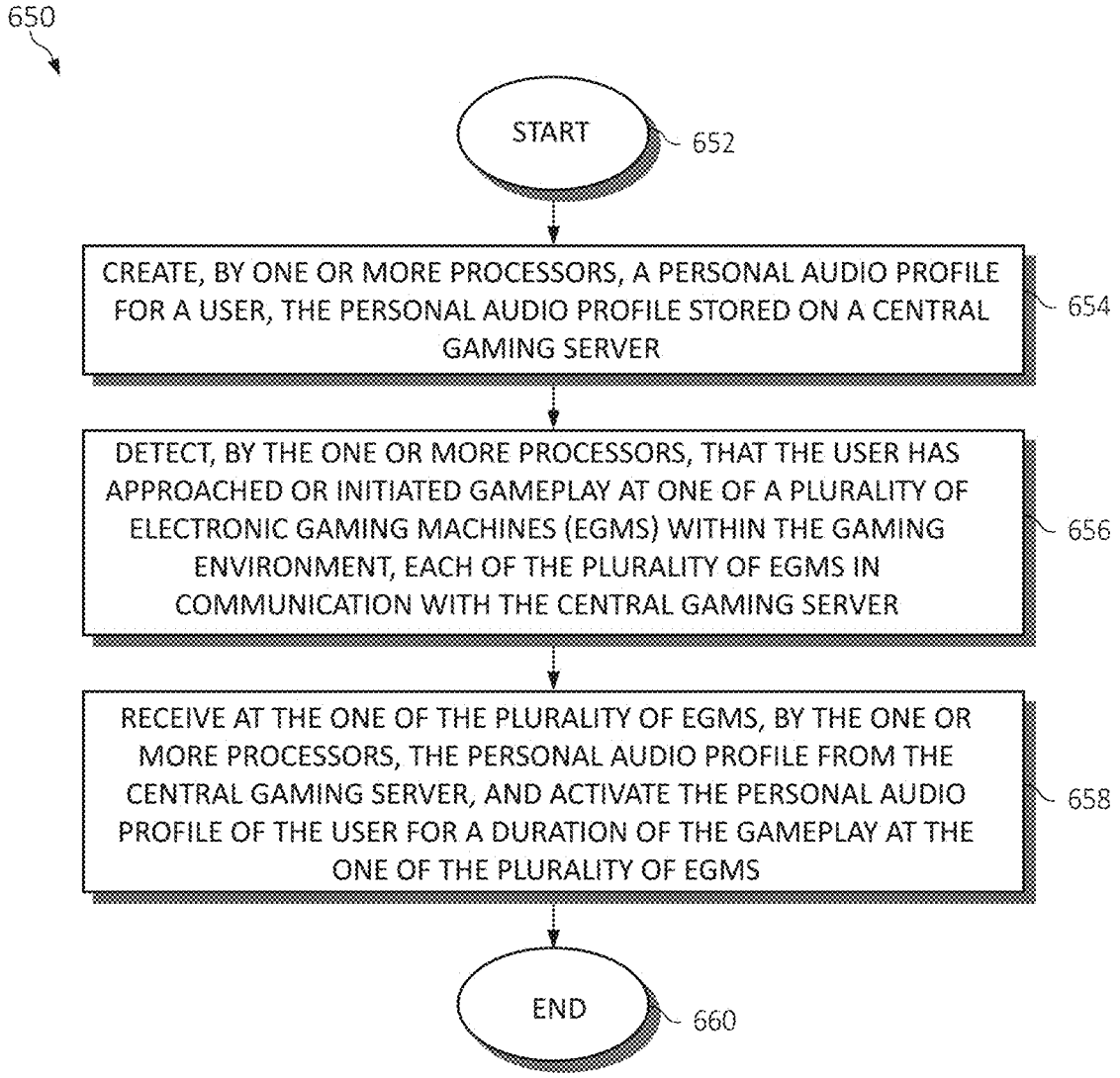
FIG. 6 is a flowchart diagram illustrating an exemplary method for personalized acoustical optimization of sound characteristics generated by one of the electronic gaming machines of the gaming system of FIG. 1.

Now referring to FIG. 6, a flowchart diagram illustrating an exemplary method 650 for personalized acoustical optimization within the EGMs 100 or 150 is depicted. The method 650 begins (step 652) by creating, by the one or more processors, a personal audio preference profile for a player, the personal audio preference profile being stored on the EGMs 100, 150, the central gaming server 620, and/or the mobile device 640 (step 654). A processor associated with the EGMs 100, 150 (e.g., processor 1010) then detects that the player has initiated game play at one of the EGMs 100, 150 within the gaming environment, where each of the EGMs 100, 150 are in communication with the central gaming server 620 and/or the mobile device 640 via the network 630 (step 656). The processor associated with the EGMs 100, 150 receive the personal audio preference profile from the mobile device 640 and/or the central gaming server 620, and activates the personal audio preference profile of the player for a duration of the game play at the particular EGM 100, 150 of which the player is currently engaged in a gaming session (step 658). The method 650 ends (step 660).

In conjunction with the method 650, in some embodiments, detecting the player has initiated game play further comprises identifying credentials of the player through a player identification mechanism integrated into the one of the EGMs 100, 150; and identifying a mobile device having credentials associated with the player has entered within a predetermined physical distance of the one of the EGMs 100, 150.

In conjunction with the method 650, in some embodiments, an input source of the mobile device 640 is used to capture ambient noise encompassing the player within the gaming environment; data associated with the captured ambient noise is transferred from the mobile device 640 to the one of EGMs 100, 150; and the audio produced by the ones of the plurality of speakers 380, 390 of the one of the EGMs 100, 150 is actively equalized according to the data received by the mobile device 640.

In conjunction with the method 650, in some embodiments, the personal audio preference profile is used to determine other audio, alternative to the audio associated with the game play, to play for the player; and the other audio is played at predetermined times through the ones of the plurality of speakers 380, 390 of the one of the EGMs 100, 150 according to the determination.

In conjunction with the method 650, in some embodiments, an AI algorithm is used to modify the personal audio preference profile of the player according to a time of day the game play is initiated at the one of the EGMs 100, 150; a type of game being played during the game play at the one of the EGMs 100, 150; and/or a game event associated with the game play at the one of the EGMs 100, 150.

The flowcharts and block diagrams in the above figures illustrate the architecture, functionality, and operation of possible implementations of apparatuses, systems, methods and/or computer program products according to various embodiments of the present disclosure. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

What is claimed is:

1. A method for operating a gaming system, said method comprising:

detecting a player at an electronic gaming machine;

receiving, via the electronic gaming machine, a personal audio preference profile for the player from a remote personal audio preference profile storage device;

using, via the electronic gaming machine, the received personal audio preference profile to output audio based on the personal audio preference profile;

subsequently outputting adjusted audio;

responsive to receiving an approval of the outputted adjusted audio from the player via an input device, automatically modifying the personal audio preference profile based on the outputted adjusted audio and communicating the modified personal audio preference profile to the remote personal audio preference profile storage device; and modifying, using an artificial intelligence algorithm, the personal audio preference file, and communicating the modified personal audio preference profile to the remote personal audio preference profile storage device.

2. The method of claim 1, wherein the remote personal audio preference profile storage device comprises a mobile device of the player.

3. The method of claim 1, further comprising receiving data regarding ambient noise from one of a mobile device and a microphone of the electronic gaming machine.

4. The method of claim 1, further comprising enabling the player to directly modify the personal audio preference profile, and communicating the modified personal audio preference profile to the remote personal audio preference profile storage device.

5. A method for operating a gaming system, said method comprising:

detecting a player at an electronic gaming machine;

causing the electronic gaming machine to provide game play for the player;

causing the electronic gaming machine to create a personal audio preference profile for the player during the game play provided by the electronic gaming machine, which comprises obtaining an input from the player regarding the player's personal audio preferences and obtaining data from a database not associated with the gaming system and that stores a player personal audio preference;

communicating the created personal audio preference profile to a remote personal audio preference profile storage device; and modifying, using an artificial intelligence algorithm, the personal audio preference profile, and communicating the modified personal audio preference profile to the remote personal audio preference profile storage device.

6. The method of claim 5, wherein the remote personal player audio preference profile storage device comprises a mobile device of the player.

7. An electronic gaming machine comprising:

a display device;

a sound producing device;

an input device;

a processor; and a memory device that stores a plurality of instructions, which when executed by the processor, causes the processor to:

detect, via the input device, that a player has initiated game play, display, via the display device, the game play, and use a personal audio preference profile for the player to output audio via the sound producing device and based on the personal audio preference profile;

modify, using an artificial intelligence algorithm, the personal audio preference profile;

receive data associated with ambient noise; and output via the sound producing device audio offsetting to the ambient noise.

8. The electronic gaming machine of claim 7, which further comprises a communications module, and wherein the plurality of instructions, when executed by the processor, cause the processor to send a request to a remote personal audio preference profile storage device for the personal audio preference profile for the player.

9. The electronic gaming machine of claim 8, wherein the plurality of instructions, when executed by the processor, cause the processor to receive the personal audio preference profile for the player from the personal audio preference profile storage device.

10. The electronic gaming machine of claim 7, wherein the plurality of instructions, when executed by the processor, cause the processor to operate with the input device to receive an input by the player to create the personal audio preference profile.

11. The electronic gaming machine of claim 10, which further comprises a communications module, and wherein the plurality of instructions, when executed by the processor, cause the processor to send, via the communications module, the personal audio preference profile for the player to a remote personal audio preference profile storage device.

12. The electronic gaming machine of claim 7, wherein the personal audio preference profile comprises a plurality of different sound related characteristics.

13. The electronic gaming machine of claim 7, further comprising a player identification mechanism.

14. The electronic gaming machine of claim 7, wherein the plurality of instructions, when executed by the processor, cause the processor to update the personal audio preference profile based on an input made by the player using the input device.

15. The electronic gaming machine of claim 7, wherein the plurality of instructions, when executed by the processor, cause the processor to update the personal audio preference profile based on an input made by the player using the input device during the game play.

16. The electronic gaming machine of claim 8, wherein when executed by the processor, the instructions cause the processor to use player position data in conjunction with the personal audio preference profile for the player to output audio via the sound producing device.

17. The electronic gaming machine of claim 8, wherein when executed by the processor, the instructions cause the processor to use player image data in conjunction with the personal audio preference profile for the player to output audio via the sound producing device.

* * * * *